US006275138B1

(12) United States Patent
Maeda

(10) Patent No.: US 6,275,138 B1
(45) Date of Patent: Aug. 14, 2001

(54) VARIABLE RESISTOR CHANGING RESISTANCE VALUE BY PRESSING

(75) Inventor: Ryoichi Maeda, Miyagi-ken (JP)

(73) Assignee: ALPS Electric Co., Ltd., Tokyo (JP)

( * ) Notice: Subject to any disclaimer, the term of this patent is extended or adjusted under 35 U.S.C. 154(b) by 0 days.

(21) Appl. No.: 09/589,023

(22) Filed: Jun. 7, 2000

(30) Foreign Application Priority Data

Jun. 10, 1999 (JP) ..... 11-163599

(51) Int. Cl.[7] ..... H01C 10/10
(52) U.S. Cl. ..... 338/47; 338/99; 338/128
(58) Field of Search ..... 338/47, 99, 100, 338/101, 113, 114, 309, 128

(56) References Cited

U.S. PATENT DOCUMENTS 4,111,091 * 9/1978 Hinago ..... 84/1.01
4,257,305 * 3/1981 Friend et al. ..... 84/1.24
4,630,025 * 12/1986 Bourolleau ..... 338/309
4,897,629 * 1/1990 Lecklider ..... 338/128
5,914,559 * 6/1999 Muchi et al. ..... 313/479
5,999,084 * 12/1999 Armstrong ..... 338/114
6,102,802 * 8/2000 Armstrong ..... 463/37

* cited by examiner

*Primary Examiner*—Karl D. Easthom
*Assistant Examiner*—Kyung S. Lee
(74) *Attorney, Agent, or Firm*—Brinks Hofer Gilson & Lione

(57) ABSTRACT

The conventional variable resistor has a problem in that, because a pressure-sensitive member made of a pressure-sensitive conductive rubber is used, a serious scattering is caused in the characteristic (change curve), and scattering of thickness in the manufacture of the pressure-sensitive member results in a large scatter of the characteristic (change curve). The variable resistor of the invention uses the first resistor pattern forming the variable resistor. It is therefore possible to provide a variable resistor which scattering in the manufacture is smaller, can achieve a uniform resistance change characteristic, and gives a high accuracy.

7 Claims, 7 Drawing Sheets

VARIABLE RESISTOR CHANGING RESISTANCE VALUE BY PRESSING

BACKGROUND OF THE INVENTION

1. Field of the Invention

The present invention relates to a variable resistor adapted to be used for a video game machine or the like.

2. Description of the Related Art

A conventional variable resistor will be described with reference to FIGS. 10 to 13. An insulated substrate 32 is housed in a case 31 comprising a synthetic resin form.

A fixed contact 33 having a pair of comb-shaped contacts formed at a certain interval on one side surface of the insulated substrate 32 as shown in FIGS. 11 and 13.

A fixed resistor 34 is attached to the other surface of the insulated substrate. As shown in FIG. 13, connection of the fixed contact 33 and the fixed resistor 34 is accomplished by connecting one of the contacts of the fixed contact 33 and a side of the fixed resistor with a connection line 35. The other contact of the fixed contact 33 is grounded with a connection line 36. The other end of the fixed resistor 34 is connected to a power supply terminal T1 via a connection line 37. An outgoing terminal T2 is connected to the connection line 35 via a connection line 38.

A pressure-sensitive member 39 is made of a disk-shaped pressure-sensitive conductive rubber. This pressure-sensitive member 39 is arranged to be spread over the pair of fixed contacts 33.

A buffer member 40 is made of a rubber material. The buffer member 40 is placed on the upper surface of the pressure-sensitive member 39 in a state in which it faces the fixed contact 33, and attached thereto by an adhesive or the like.

An operating member 41 comprising a synthetic resin form or the like is positioned on the upper surface of the buffer member 40 and attached in a state projecting from a hole 31*a* of the case 31.

Operation of the conventional variable resistor having the aforementioned configuration will now be described. When pressing the upper surface of the operating member 41, the pressure-sensitive member 39 is pressed via the buffer member 40 and deformed under the pressure to cause a change in resistance value at the portion of the pressure-sensitive member 39 thus pressed. The change in resistance value caused by a change in this pressing force is detected between the pair of comb-shaped contacts of the fixed contact 33.

Upon release of the pressing operation of the operating member 41, the pressure-sensitive member 39 and the buffer member 40 recover the original state thereof under the effect of their own elasticity, and at the same time, the operating member 41 as well recovers its original state.

The change characteristic of pressing force and electric resistance when using the pressure-sensitive member 39 is such that, as shown in FIG. 12, the resistance value steeply changes in the initial stage of pressing, exhibits a curved change in the middle stage that follows, and almost no change in the final stage, as represented by a change curve K2.

Because the pressure-sensitive member 39 is made of a pressure-sensitive conductive rubber, the characteristic (change curve) shows a large scattering, and in the manufacture of the pressure-sensitive member 39, furthermore, a scatter occurs in thickness, resulting in a serious scattering of characteristic (change curve).

Such a variable resistor is adapted to be used in an electric circuit diagram as shown in FIG. 13, incorporated in a game machine or the like.

In this circuit diagram, when a voltage is impressed between a terminal T1 and the connection line 36, an output voltage available between the fixed resistor 34 and the variable resistor based on the pressure-sensitive member 39 on the fixed contact 33 is taken out from a terminal T2.

When using such a variable resistor, for example, for speed operation of vehicle in a game machine, the resistance value steeply changes in the initial stage of pressing operation of the operating member 41, thus making it difficult to perform speed operation. In the latter stage of pressing operation, there is almost no change in resistance value. This causes the operator to feel an uncomfortable sense of being out of tune with the speed relative to the pressing operation.

When utilizing only the curved changing portion in the middle of the change curve K2, the slight change in resistance value during this course leads to a poorer operability.

In the conventional variable resistor, the use of the pressure-sensitive member 39 made of a pressure-sensitive conductive rubber causes a serious scattering of characteristic (change curve). Further, in the manufacture of the pressure-sensitive member 39, scattering of thickness poses a problem of a large scattering of the characteristic (change curve).

When using the variable resistor using a pressure-sensitive member 39, for example, for speed operation of a vehicle in a game machine, a steep change in resistance value in the initial stage of pressing operation of the operating member 41 makes it difficult to perform speed operation, and in the latter stage of pressing operation, the slightest change in resistance value causes a problem of a serious feeling of uncomfortability of being out of tune with the speed relative to the pressing operation.

When using only the curved changing portion in the middle of the change curve K2 of the pressure-sensitive member 39, the slightest change in resistance value in this middle stage leads to a problem of a poorer operability.

In this case, the pressure-sensitive member 39 is always in a state of preliminarily being pressed by the fixed contact 33. The pressure in this case is not constant under the effect of dispersion of size of parts and assembly, thus resulting in a serious scatter of output derived from the outgoing terminal T2 in the non-operating state. In addition, deterioration with time of elasticity of the pressure-sensitive member 39 leads to a problem of a shorter service life. Since it is necessary to use the fixed resistor 34 separately from the variable resistor and the fixed resistor 34 is attached and wired onto the insulated substrate 32, there is posed another problem of complicated operation and a higher cost.

SUMMARY OF THE. INVENTION

As first means for solving the aforementioned problems, there is provided a configuration in which a variable resistor comprises an insulated substrate; first and second resistor patterns formed on the insulated substrate; a first conductor pattern electrically connecting ends on one side of the first and second resistor patterns; a deformable conductive contact, having a convex curved surface toward the insulated substrate, and arranged opposite to the first resistor pattern; and a holding member having the conductive contact provided thereon; wherein the conductive contact is caused to deform to change the contact area so as to agree with the first resistor pattern so that the resistance value is variable.

Second solving means is a configuration in which second and third conductor patterns are formed in electrical communication with the other ends of the first and second resistor patterns; and the first resistor pattern positioned between the first and second conductor patterns has a resistance value larger than the resistance value of the second resistor pattern positioned between the first and third conductor patterns.

Third solving means is a configuration in which the first conductor pattern has a belt-shaped portion; a resistive element is formed by printing so as to extend in two opposite directions across the belt-shaped portion; the first resistor pattern is composed of the resistive element extending in one of the directions, and the second resistor pattern is composed of the resistive element extending in the other direction.

Fourth solving means is a configuration in which the upper surface of the second resistor pattern is covered with an insulating layer.

Fifth solving means is a configuration in which the conductive contact has a width larger than the width of the first resistor pattern formed into a rectangular shape so that the conductive contact is in contact with the whole width of the rectangle of the first resistor pattern.

Sixth solving means is a configuration in which the conductive contact is made by mixing a rubber material with carbon.

Seventh solving means is a configuration in which the holding member has legs formed so as to be in contact with the insulated substrate and surround the conductive contact; and the legs have an opening in a direction of the curved surface.

DESCRIPTION OF THE PREFERRED EMBODIMENTS

Figure 1:
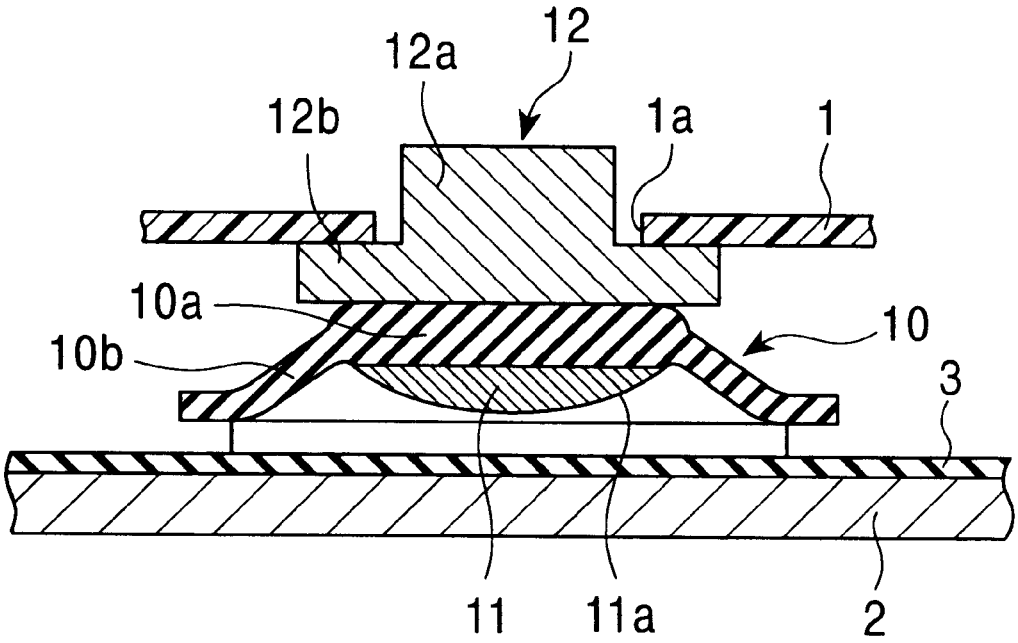
FIG. 1 is a partial sectional view of the variable resistor of the present invention.
Figure 2:
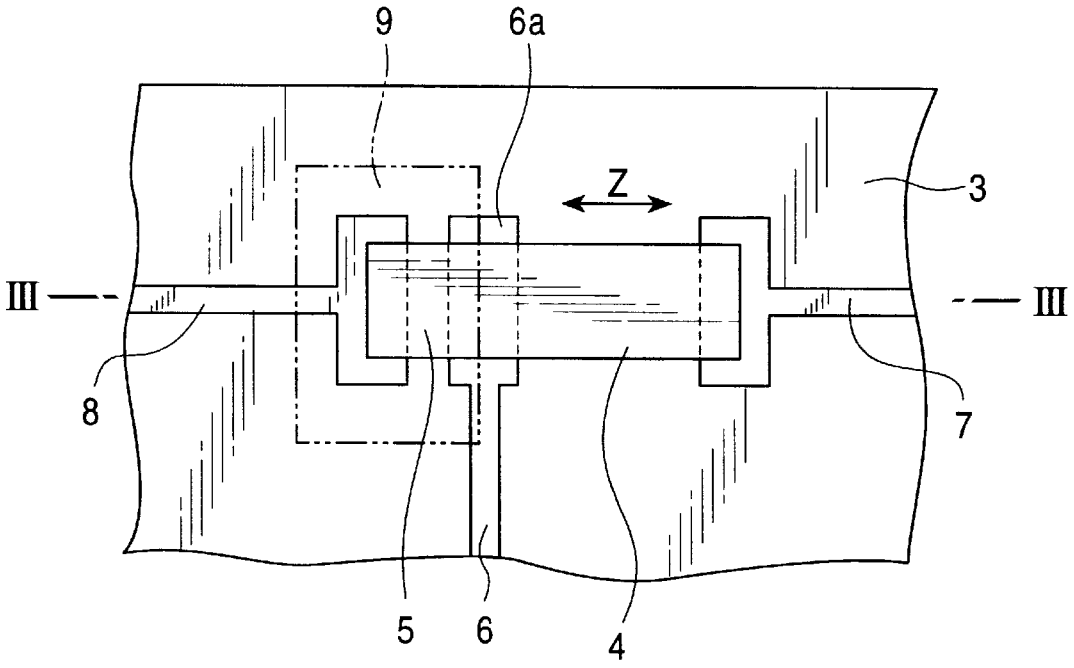
FIG. 2 is a plan view of an insulated substrate in the variable resistor of the invention.
Figure 3:
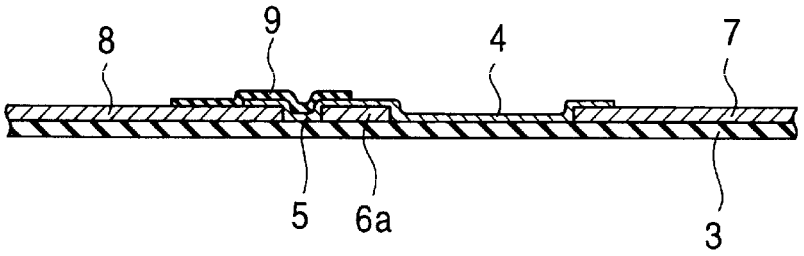
FIG. 3 is a sectional view of FIG. 2 cut along the line III—III.
Figure 4:
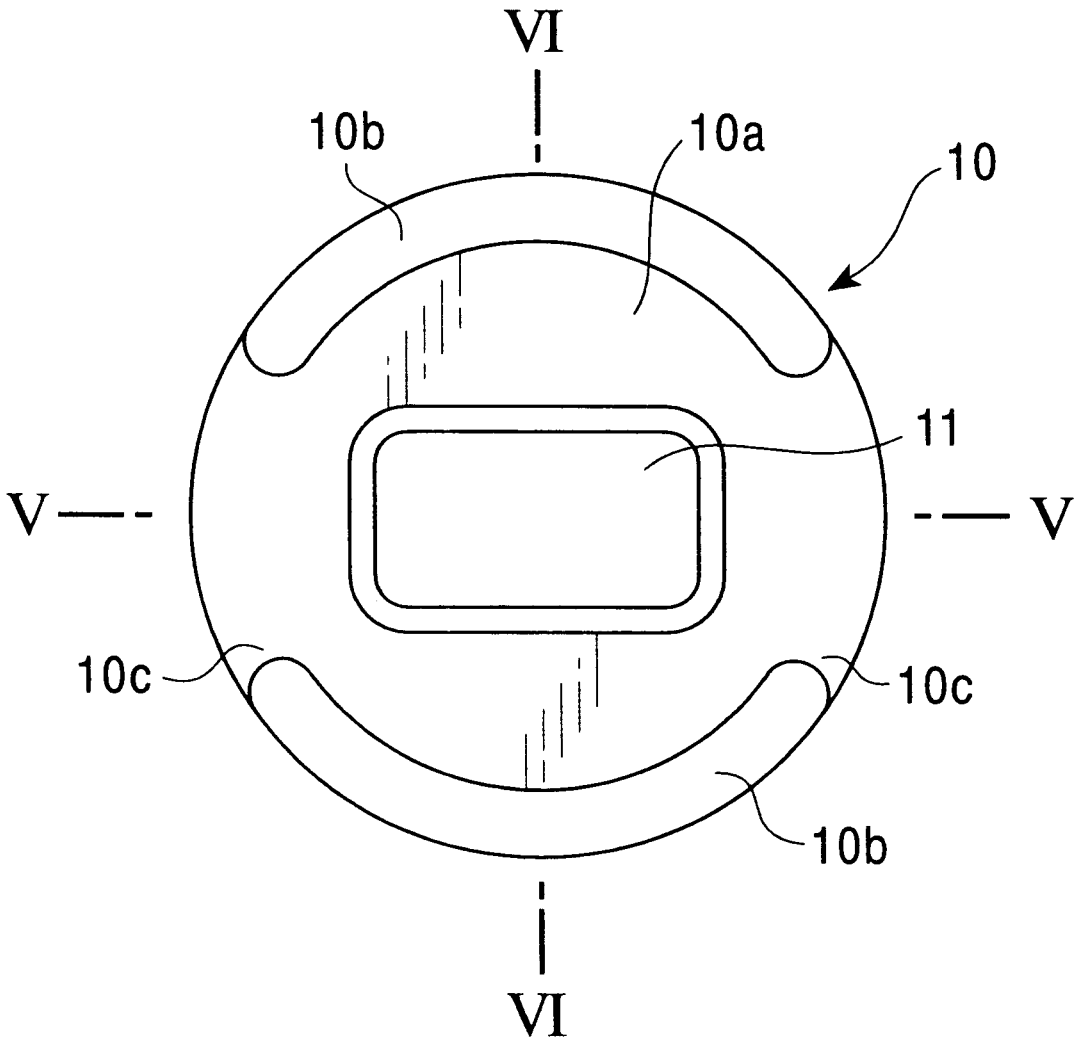
FIG. 4 is a bottom view of a holding member in the variable resistor of the invention.
Figure 5:
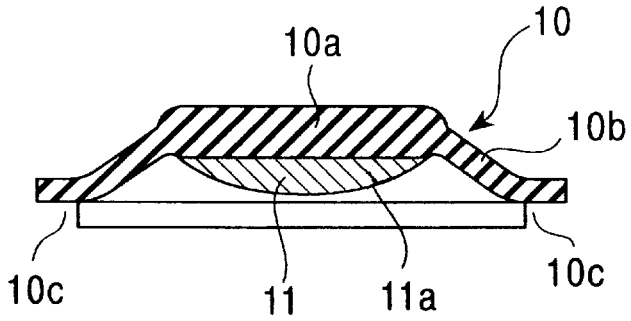
FIG. 5 is a sectional view of FIG. 4 cut along the line V—V.
Figure 6:
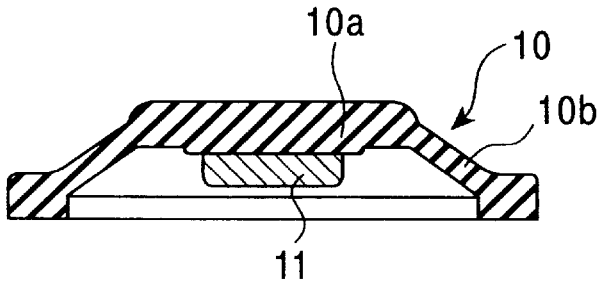
FIG. 6 is a sectional view of FIG. 4 cut along the line VI—VI.
Figure 7:
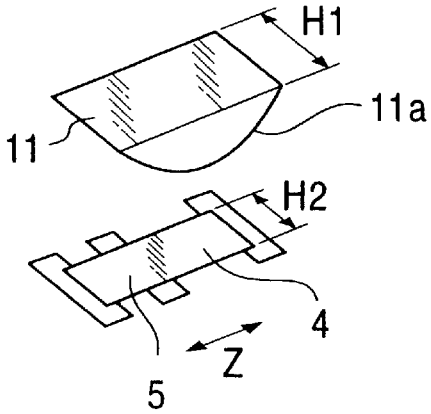
FIG. 7 is a descriptive view illustrating the relationship between the conductive contact and the resistor pattern in the variable resistor of the invention.
Figure 8:
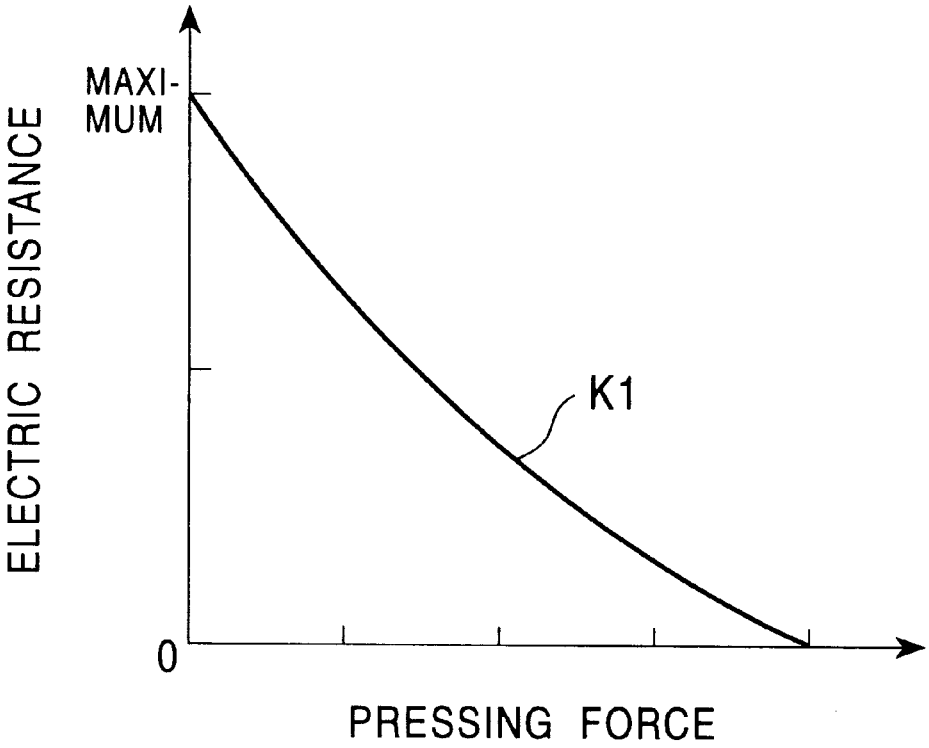
FIG. 8 is a graph illustrating the change characteristic of pressing force and electric resistance in the variable resistor of the invention.
Figure 9:
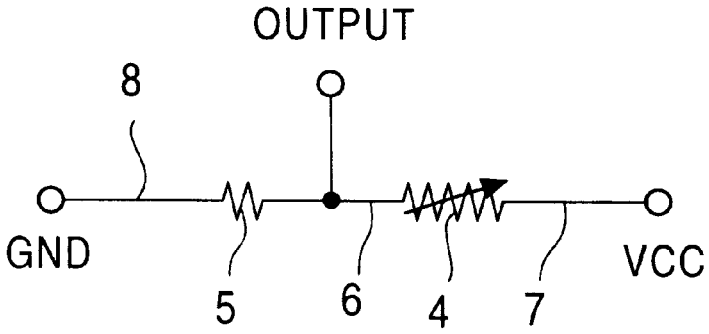
FIG. 9 is a circuit diagram of the variable resistor of the invention.
Figure 10:
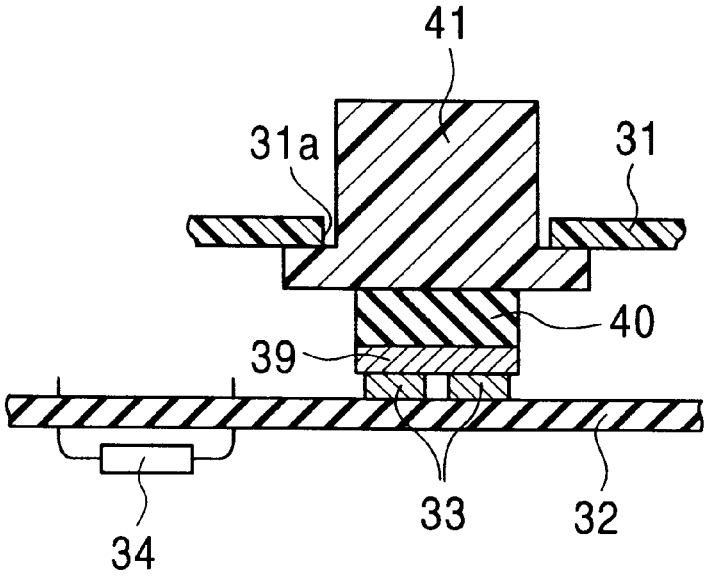
FIG. 10 PRIOR ART
FIG. 10 is a partial sectional view of a conventional variable resistor.
Figure 11:
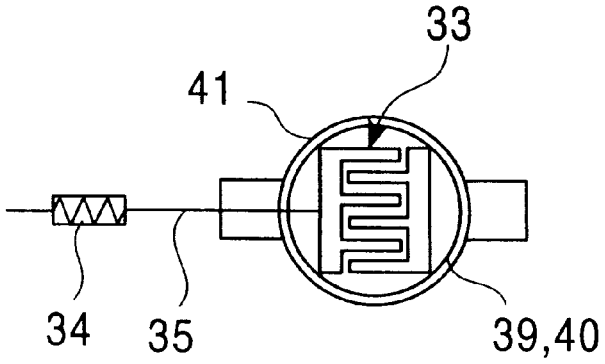
FIG. 11 PRIOR ART
FIG. 11 is a descriptive view illustrating the relationship between the fixed contact and the buffer member of the pressure-sensitive member in the conventional variable resistor.

The variable resistor of the present invention will now be described with reference to FIGS. 1 to 9. FIG. 1 is a partial sectional view of the variable resistor of the present invention; FIG. 2 is a plan view of an insulated substrate in the variable resistor of the invention; FIG. 3 is a sectional view of FIG. 2 cut along the line III—III; FIG. 4 is a bottom view of a holding member in the variable resistor of the invention; FIG. 5 is a sectional view of FIG. 4 cut along the line V—V; FIG. 6 is a sectional view of FIG. 4 cut along the line VI—VI; FIG. 7 is a descriptive view illustrating the relationship between the conductive contact and the resistor pattern in the variable resistor of the invention; FIG. 8 is a graph illustrating the change characteristic of pressing force and electric resistance in the variable resistor of the invention; and FIG. 9 is a circuit diagram of the variable resistor of the invention.

The variable resistor of the invention will now be described with reference to FIGS. 1 to 9. A case 1 comprising a synthetic resin form or the like has a hole 1*a*. A rectangular substrate 2 serving as a supporting substrate comprises a hard insulated substrate or the like, and in a state in which it is housed in the case 1, is attached to the case 1 by appropriate means.

The rectangular insulated substrate 3 comprises a flexible insulating material. A first resistor pattern 4 for the rectangular variable resistor and a second resistor pattern 5 for a rectangular fixed resistor are arranged in parallel with each other on the upper surface of the insulated substrate 3 as shown in FIG. 2.

A first conductor pattern 6 having a belt-shaped portion 6*a* is formed below the boundary between the first and second resistor patterns 4 and 5 on the upper surface of the insulated substrate 3. The belt-shaped portion 6*a* connects the ends of the first and second resistor patterns 4 and 5. A second conductor pattern 7, positioned below the other end of the first resistor pattern 4, electrically communicates with the first resistor pattern 4, and a third conductor pattern 8, positioned below the other end of the second resistor pattern 5, electrically communicates with the second resistor pattern 4. These conductor patterns 7 and 8 are formed on the upper surface of the insulated substrate 3.

In this connecting configuration, circuits are arranged as shown in FIG. 9. The first conductor pattern 6 takes the form of a pattern for taking out an output voltage (OUTPUT) available between the first and second resistor patterns 4 and 5 when a voltage is impressed between the third conductive pattern 8 for grounding (GND) and the second conductor pattern 7 for power supply (VCC).

The insulating layer 9 comprising an insulating material is formed on the upper surface of the insulated substrate 3 so as to cover the entire surface of the second resistor pattern 5 for fixed resistance and portions of the first and third conductor patterns 6 and 8.

The method for forming these first and second resistor patterns 4 and 5, the first, second and third conductor patterns 6, 7 and 8, and the insulating layer 9 comprises the following steps. First, the first, second and third conductor patterns 6, 7 and 8 comprising a silver paste are simultaneously formed by printing on the insulated substrate 3.

Then, the first and second resistor patterns 4 and 5 are simultaneously formed by printing a carbon resistor paste into rectangular shapes over the first, second and third conductor patterns 6, 7 and 8, extending across the belt-shaped portion 6*a* of the first conductive pattern 6 in two opposite directions.

Finally, the insulating layer 9 is formed by printing an insulating paste comprising an insulating material so as to cover the second resistor pattern 5, thus completing the manufacture.

The insulated substrate 3 having the aforementioned configuration is attached to the upper surface of the substrate 2 by appropriate means including sticking with an adhesive.

The holding member 10 comprising a form of an elastic material such as rubber is in a dome shape as shown in FIGS. 4 to 6, and has a holding portion 10*a* serving as a ceiling plate, a dome-shaped leg 10*b* extending downward from the holding portion 10*a*, and a notch-shaped opening 10*c* provided on the leg 10*b* face to face.

The arcuate conductive contacts 11 are formed by mixing carbon with a rubber material. These conductive contacts 11 are attached to the lower part of the holding portion 10*a* while being surrounded by the leg 10*b* of the holding member 10.

These conductive contacts 11 are formed integrally with the holding member 10 by forming simultaneously with forming of the holding member 10. Each of these conductive contacts has a curved surface 11*a* convex downward as shown in FIGS. 1, 5 and 7, and this curved surface 11*a* is formed with the center portion at the lowest position.

The holding member 10 having the conductive contacts 11 attached thereto, with the first resistor pattern 4 surrounded by the leg 10*b*, is placed with the lower part of the leg 10*b* in contact with the insulated substrate 3.

At this point, the arcuate conductive contacts 11 has the convex curved surface 11*a* arranged opposite to the insulated substrate 3 so as to cover the first rectangular resistor pattern 4 and to face the first resistor pattern 4.

When pressing the upper part of the holding portion 10*a* facing the first resistor pattern 4 in this state, the leg 10*b* is elastically deformed. The curved surface 11*a* of the conductive contact 11 comes into contact with the center portion of the first resistor pattern 4. When the holding portion 10*a* is further pressed, the curved surface 11*a* deforms, and the contact area with the first resistor pattern 4 increases gradually, thus leading to a smaller resistance value at the both ends of the first resistor pattern 4, and imparting the functions as a variable resistor.

When pressing of the holding portion 10*a* is released, the holding portion 10*a* recovers the original state thereof under the effect of elasticity of the legs 11*b*, and in the meantime, the contact area of the curved surface 11*a* with the first resistor pattern 4 gradually decreases while changing the resistance value. The curved surface 11*a* thus recovers the original state thereof.

More specifically, by pressing the holding portion 10*a*, the conductive contacts 11 deform in a resistance changing face direction Z which is the direction changing the contact area of the first resistor pattern 4, increasing or reducing the contact area so as to make the resistance value variable.

Upon this deformation of the conductive contacts 11, the presence of the insulating layer 9 prevents contact with the second resistor pattern 5 which is a fixed resistor.

The width H1 of the conductive contact 11 is larger than the width in a direction at right angles to the resistance changing face direction Z of the first resistor pattern 4 (shorter side width) H2, so that the conductive contacts 11 can be in contact with the entire width H2 of the resistor pattern.

The opening 10*c* of the holding member 10 is in the forming direction of the curved surface 11*a* of the conductive contact 11, and is formed in the resistance changing face direction Z (longer side of the first resistor pattern 4), so as to improve the deformation operation of the conductive contacts 11 by reducing the interference of the leg 10 in the resistance changing face direction Z which is the deforming direction of the conductive contacts 11.

The operating member 12 comprising a synthetic resin form has a grip 12*a*, and a flange-shaped support 12*b* formed integrally with the grip 12*a*.

The operating member 12 causes the grip 12*a* to project outside from the hole 1*a* of the case 1, and houses the support 12*b* in the case 1. It places the support 12*b* on the holding portion 10*a* of the holding member 10 and elastically presses the support 12*b* against the inner surface of the case 1 under the effect of elasticity of the holding member 10 and attaches the support 12*b* to the case 1 so as to be capable of pressing.

Operation of the variable resistor of the invention having the aforementioned configuration will now be described. First, when the upper surface of the operating member 12 is pressed against elasticity of the leg 10*b*, the holding portion 10*a* of the holding member 10 is pressed by the support 12*b*. As a result, the leg 10*b* are elastically deformed, and the curved surface 11*a* of the conductive contact 11 comes into contact with the center portion of the first resistor pattern 4. When the holding portion 10*a* is further pressed, the curved surface 11*a* deforms in the resistance changing face direction. This causes a gradual increase in the contact area with the first resistor pattern 4, thus making the resistance value on the both ends of the first resistor pattern 4 variable.

When the pressing operation of the operating member 12 is released, the holding portion 10*a* recovers the original state thereof under the effect of elasticity of the leg 10*b*, and the operating member 12 recovers the original state thereof by elasticity of the legs 10*b*. In the meantime, the contact area of the curved surface 11*a* with the first resistor pattern 4 gradually decreases while causing a change in the resistance value, and the curved surface 11*a* recovers the original state thereof. As a result, it is possible to change the resistance value by causing a change in the contact area of the conductive contacts 11.

Figure 12:
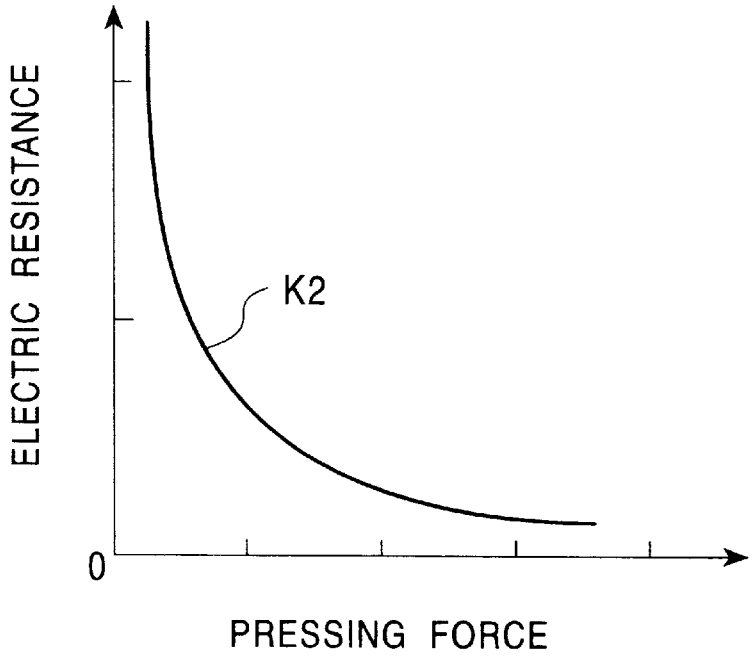
FIG. 12 PRIOR ART
FIG. 12 is a graph illustrating the change characteristic of pressing force and electric resistance in the conventional variable resistor.
Figure 13:
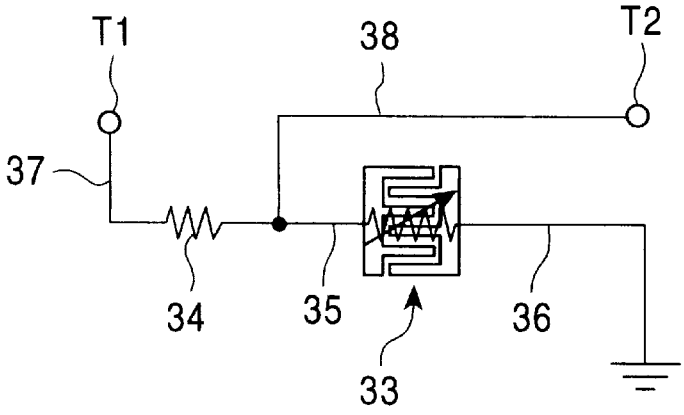
FIG. 13 PRIOR ART
FIG. 13 is a wiring diagram of the conventional variable resistor.

The change characteristic of pressing force and electric resistance for the first resistor pattern 4 when pressing the operating member 12 is such that, as shown in FIG. 8, scattering between maximum and minimum values of resistance is small, and the change takes the form of an almost linear change curve K1, as compared with the change curve K2 of a pressure-sensitive conductive rubber shown in FIG. 12.

This change curve K1 is achieved as a result of formation of the variable resistor from the first resistor pattern 4 which gives an accurate resistance value and the configuration in which the change in the contact area is caused by the conductive contacts 11.

Such a variable resistor is incorporated in a game machine and now used, for example, in an electric circuit diagram as shown in FIG. 9.

In this circuit diagram, an output voltage obtained between the first and second resistor patterns 4 and 5 upon impression of a voltage between the third connecting pattern 8 for grounding (GND) and the second conductor pattern 7 for power supply (VCC) is taken out, as derived from the output pattern (OUTPUT) of the first conductor pattern 6.

When using this variable resistor for speed operation of a vehicle in a game machine, for example, the change curve K1 shows an almost linear change throughout the entire course from the initial stage to the middle stage and the final stage of pressing operation of the operating member 12. It is therefore possible to conduct easy operation without causing an out-of-tune feeling in the speed operation, and the resistor is applicable for the entire range of the change curve K1, with a wide range of pressing operation and satisfactory operability.

The aforementioned embodiment has been described with a conductive contact 11 made by mixing carbon with a rubber material. A contact made by providing metal foil on the rubber material surface may also be used, or carbon may be printed on the rubber material.

In the variable resistor of the present invention, in which the first resistor pattern 4 forming the variable resistor is used, it is possible to provide a variable resistor with a smaller scattering in the manufacture, a more uniform resistance change property, and higher accuracy.

By pressing the holding member 10, the conductive contact 11 deforms so as to change the contact area relative to the first resistor pattern 4 to change the resistance value. It is therefore possible to bring the change curve K1 of electric resistance relative to the pressing force closer to the linear form. Particularly, when using the variable resistor of the invention in a game machine, operation free from an uncomfortability is available as compared with a conventional case. It is also possible to use the change curve K1 as a whole in operation, and therefore a variable resistor operable in a wider range of pressing operation can be provided.

In the configuration of the invention, a configuration for always elastically pressing such as a conventional pressure sensitive member is not necessary. It is therefore possible to inhibit scattering of output during non-operation, and thus to provide a variable resistor having a long service life susceptible to a smaller change with time of the conductive contact 11.

Since the fixed resistor is composed of the second resistor pattern 5, it is possible to form it by printing simultaneously with the first resistor pattern 4. It is thus possible to provide a lower-cost variable resistor requiring a smaller number of parts, with a higher operability in the manufacture as compared with the conventional one.

Because the first resistor pattern 4 which is a variable resistor has a larger resistance value than that for the second resistor pattern 5 which is a fixed resistance, the change in resistance value of the first resistor pattern 4 upon contact with the conductive contact 11 can be relatively increased, resulting in a larger change in output voltage. A variable resistor having a satisfactory operability can thus be provided.

The resistor is formed by printing so as to extend across the belt-shaped portion 6*a* of the first conductor pattern 6. The first and second resistor patterns 4 and 5 are thus formed. Both the first and second resistor patterns 4 and 5 can therefore be simultaneously provided, bringing about a better space factor, a more compact size, and it is possible to form by printing the second resistor pattern 5 which is a fixed resistance and the first resistor pattern 4 which is a variable resistance.

Even when the resistance values of the both resistor patterns 4 and 5 fluctuates, such fluctuation is never larger than the design value for one and smaller than the design value for the other, but scattering is in the same manner for the both patterns. It is therefore possible to cancel the scattering, and it is harder for an output to change even for a change in environmental conditions such as a change in temperature.

It is thus possible to provide a lower-cost variable resistor requiring a smaller number of parts and giving a higher operability of manufacture as compared with the conventional art.

By covering the second resistor pattern 5 which is a fixed resistance with the insulating layer 9, it is possible to provide a variable resistor in which the conductive contact 11 never comes into contact with the second resistor pattern 5 upon deformation of the conductive contact 11, and exerts no adverse effect on the properties.

The conductive contact 11 is formed with a width H1 larger than the width H2 of the rectangular first resistor pattern 4 so that the conductive contact 16 comes into contact with the full rectangular width of the resistor pattern 4. As a result, the conductive contact 11 comes into contact with the full width of the first resistor pattern 4 upon pressing, thus stabilizing the contact area with the first resistor pattern 4 upon pressing, thus making it possible to provide a variable resistor giving satisfactory accuracy of a change in resistance.

Because the conductive contact 11 is formed by mixing carbon with the rubber material, the service life of the conductive contact 11 can be extended.

The holding member 10 is made of an elastically deformable rubber material, and the conductive contact 11 is formed integrally with the holding member 10. It is therefore possible to provide a low-cost variable resistor free from entanglement of the conductive contact 11 and giving a high productivity.

The holding member 10 is provided with cylindrical leg 10*b* formed so as to be in contact with the insulated substrate 3 and surround the conductive contact. This leg 10*b* serves also as the return of the conductive contact 11. It is therefore possible to provide a low-cost variable resistor requiring only a small number of parts and giving a satisfactory assembly property.

The leg 10*b* is provided with an opening 10*c* in the forming direction of the curved surface 11*a*. It is therefore possible to provide a variable resistor hardly suffering interference by the leg 10*b*, improves deforming operation of the conductive contact 11, with a higher deforming accuracy of the conductive contact 16.

What is claimed is:

1. A variable resistor comprising:

an insulated substrate;

first and second resistor patterns formed on said insulated substrate;

a first conductor pattern electrically connecting ends on one side of said first and second resistor patterns;

a deformable conductive contact, having a convex curved surface toward said insulated substrate, and arranged opposite to said first resistor pattern; and a holding member having said conductive contact provided thereon;

wherein said conductive contact deforms to change a contact area on said first resistor pattern such that a resistance value of said first resistor pattern is variable;

second and third conductor patterns are formed in electric communication with other ends of said first and second resistor patterns;

said first resistor pattern is positioned between said first and second conductor patterns, said second resistor pattern is positioned between said first and third conductor patterns, and the resistance value of said first resistor pattern is larger than a resistance value of second resistor pattern;

said first resistor pattern is a variable resistor pattern, said second resistor pattern is a fixed resistor pattern, and both of said first and second resistor patterns are simultaneously formed printed patterns; and said holding member comprises:

a holding portion serving as a ceiling plate, said conductive contact being disposed on an inner bottom surface of said holding portion; and elastically deformable flared legs extending downward from a periphery of said holding portion, a lower end of said legs contacting said insulated substrate, wherein, by performing a pressing operation on said holding member, said flared legs of said holding member are elastically deformed to gradually change the contact area of said conductive contact in relation to said first resistor pattern, thereby gradually varying the resistance of said first resistor pattern.

2. A variable resistor according to claim 1, wherein said first conductor pattern has a belt-shaped portion; a resistive element is formed by printing so as to extend in two opposite directions across said belt-shaped portion; said first resistor pattern is composed of said resistive element extending in one of the directions, and said second resistor pattern is composed of said resistive element extending in the other direction.

3. A variable resistor according to claim 2, wherein the upper surface of said second resistor pattern is covered with an insulating layer.

4. A variable resistor according to claim 1, wherein said conductive contact has a width larger than the width of said first resistor pattern formed into a rectangular shape so that said conductive contact is in contact with the whole width of the rectangle of said first resistor pattern.

5. A variable resistor according to claim 4, wherein said conductive contact is made by mixing a rubber material with carbon.

6. A variable resistor according to claim 1, wherein said holding member is made of an elastically deformable rubber material, and formed integrally with said conductive contact through formation of said holding member.

7. A variable resistor according to claim 6, wherein said legs have an opening in a direction of said curved surface.

* * * * *